US009803805B2

(12) United States Patent
Oliveira

(10) Patent No.: US 9,803,805 B2
(45) Date of Patent: Oct. 31, 2017

(54) HANDLE FOR PORTABLE GAS CYLINDER WITH TWO CLICK LOCKING ASSEMBLY

(71) Applicant: AMTROL Licensing Inc., West Warwick, RI (US)

(72) Inventor: Tiago Oliveira, Porto (PT)

(73) Assignee: AMTROL Licensing Inc., West Warwick, RI (US)

( * ) Notice: Subject to any disclaimer, the term of this patent is extended or adjusted under 35 U.S.C. 154(b) by 0 days.

(21) Appl. No.: 15/101,019

(22) PCT Filed: Nov. 14, 2014

(86) PCT No.: PCT/US2014/065739

§ 371 (c)(1),
(2) Date: Jun. 2, 2016

(87) PCT Pub. No.: WO2015/073849

PCT Pub. Date: May 21, 2015

(65) Prior Publication Data

US 2016/0290565 A1 Oct. 6, 2016

Related U.S. Application Data

(60) Provisional application No. 61/904,831, filed on Nov. 15, 2013.

(51) Int. Cl.

| | |
|---|---|
| ***B65D 25/28*** | (2006.01) |
| ***F17C 13/08*** | (2006.01) |
| *B65D 25/22* | (2006.01) |

(52) U.S. Cl.

CPC ..... *F17C 13/084* (2013.01); *B65D 25/2802* (2013.01); *F17C 2205/018* (2013.01);
(Continued)

(58) Field of Classification Search

CPC ..... F17C 13/084; F17C 2205/0165; F17C 2205/0308; F17C 2221/035;
(Continued)

(56) References Cited

U.S. PATENT DOCUMENTS 3,848,768 A * 11/1974 Griffin ..... F17C 13/002 220/321
4,103,806 A * 8/1978 White ..... B65D 83/40 220/724
(Continued)

FOREIGN PATENT DOCUMENTS

EP 2101103 A1 9/2009
JP 2002327899 A 11/2002
(Continued)

OTHER PUBLICATIONS

PCT International Search Report and Written Opinion dated Feb. 25, 2015 issued on corresponding PCT International Patent Application No. PCT/US2014/065739 (10 pages).
(Continued)

*Primary Examiner* — J. Gregory Pickett
*Assistant Examiner* — Niki M Eloshway
(74) *Attorney, Agent, or Firm* — Locke Lord LLP; Scott D. Wofsy; Alicia J. Carroll

(57) ABSTRACT

A handle assembly for a portable gas cylinder includes a first handle portion, a second handle portion and first and second locking members. The first handle portion includes an ergonomically configured upstanding gripping handle and a semi-circular shroud portion configured to couple to a first section of an upper portion of a portable gas cylinder. The second handle portion includes an ergonomically configured upstanding gripping handle and a semi-circular shroud portion configured to couple to a second section of the upper portion of the portable gas cylinder. First and second locking
(Continued)

members are configured to selectively locking the first and second handle portions to one another about a periphery of the upper portion of the portable gas cylinder.

12 Claims, 16 Drawing Sheets

(52) U.S. Cl.
CPC ..... *F17C 2205/0165* (2013.01); *F17C 2205/0169* (2013.01); *F17C 2205/0308* (2013.01); *F17C 2221/035* (2013.01); *F17C 2223/0153* (2013.01); *F17C 2223/033* (2013.01); *F17C 2260/015* (2013.01); *F17C 2270/0745* (2013.01)

(58) Field of Classification Search
CPC ..... F17C 2223/0153; F17C 2223/033; F17C 2260/015; F17C 2270/0745; F17C 2205/0169; F17C 2205/018; B65D 25/2802
USPC ..... 220/755, 758, 759
See application file for complete search history.

(56) References Cited

U.S. PATENT DOCUMENTS 4,600,033 A * 7/1986 Baron ..... F17C 13/002 137/382
4,678,003 A * 7/1987 Griffin ..... F16K 35/10 137/382
5,058,758 A * 10/1991 Suddeth ..... F16K 35/10 137/382
5,845,809 A * 12/1998 Garrett ..... F16K 35/10 220/728
7,255,245 B2 8/2007 Oliveira et al.
D559,348 S 1/2008 Dias et al.
D566,807 S 4/2008 Oliveira et al.
D576,702 S 9/2008 Aguiar et al.
8,215,517 B2 7/2012 Chohfi et al.
2006/0065672 A1* 3/2006 Lecourt ..... F17C 1/04 222/3
2006/0070662 A1* 4/2006 Gremillion ..... F16K 27/12 137/382
2009/0272443 A1 11/2009 Lee
2010/0012663 A1 1/2010 Andreani et al.
2011/0154868 A1* 6/2011 Eizen ..... F17C 13/04 70/164
2012/0248128 A1* 10/2012 Chohfi ..... B65D 25/22 220/769
2013/0277376 A1* 10/2013 Liebenberg ..... F17C 13/085 220/589
2015/0167896 A1* 6/2015 Frenal ..... F17C 13/06 53/468

FOREIGN PATENT DOCUMENTS

WO WO-8802832 A1 4/1988
WO WO-2006/060338 A2 6/2006
WO WO-2012038687 A1 3/2012

OTHER PUBLICATIONS

Extended Search Report dated May 23, 2017 in connection with co-pending EP Application No. 14862762.3.

* cited by examiner

HANDLE FOR PORTABLE GAS CYLINDER WITH TWO CLICK LOCKING ASSEMBLY

CROSS-REFERENCE TO RELATED APPLICATIONS

This application is a U.S. National Stage Application of PCT/US2014/065739 filed Nov. 14, 2014, which claims the benefit of and priority to U.S. Provisional Patent Application No. 61/904,831, filed Nov. 15, 2013. The contents of both applications are incorporated herein by reference in their entirety.

BACKGROUND

1. Field of the Disclosure

The subject disclosure is directed to a handle assembly for a portable gas cylinder, and more particularly, to a removable handle assembly that protects the valve located on the top of a portable gas cylinder, and to a method of attaching the handle assembly to the gas cylinder and subsequently removing the handle assembly from the gas cylinder.

2. Description of Related Art

Compressed gas cylinders are well known in the art and have been widely used in various applications, such as, for example, the storage of Liquefied Petroleum Gas (LPG) for cooking appliances such as stoves and grills. A compressed gas cylinder generally comprises a steel cylindrical body having a valve at the top for controlling the flow of gas from cylinder and a footing at the bottom to provide stability for the cylinder upon a supporting surface. A steel ring is typically welded to the top of the cylinder to surround the valve for protection.

Gas cylinders are generally intended for multiple uses within a deposit and return system. The cylinder is periodically checked when it arrives at the filling station to be refilled. This may occur three or four times a year. In accordance with the findings of this checking, it may be decided that the gas cylinder be refurbished. In order for a gas cylinder to be reprocessed or refurbished, the welded top ring may have to be separated from the cylinder. In known designs, the body of the gas cylinder is often damaged in this separation process, causing the entire unit to be scrapped. A further disadvantage of using steel top rings to protect the valve is its relative weight.

Some known protector designs attempt to address the excessive weight problem associated with steel rings welded to the top of gas cylinders by providing a synthetic protective mold that is intimately linked to the gas cylinder. Although, the resulting protector is lighter than a steel ring welded to the top of the gas cylinder, this proposed solution, prevents the visual inspection of the gas cylinder. Moreover, removal of the molded plastic material linked to the steel cylinder is almost impossible without causing major damage to the steel cylinder.

SUMMARY

In view of the foregoing, it is an object of the disclosure to provide a protective device that protects the valve at the top of a gas cylinder from damage, is light weight, allows for visual inspection of the gas cylinder without damaging the gas cylinder, and can be easily removed from the gas cylinder without damaging the cylinder or the device itself, so that it can be reused again with another cylinder. It is advantage of the subject technology to provide a protective device for gas cylinders having ergonomic grips for handling purposes. Additionally, handles in accordance with the subject disclosure will facilitate stacking of multiple cylinders.

Embodiments of the subject invention are directed to a new and useful handle assembly for a portable gas cylinder. The handle assembly includes a first handle portion, a second handle portion, and first and second locking members. First handle portion includes an ergonomically configured upstanding gripping handle and a semi-circular shroud portion configured to encircle a first section of an upper portion of a portable gas cylinder. Second handle portion includes an ergonomically configured upstanding gripping handle and a semi-circular shroud portion configured to encircle a second section of the upper portion of a portable gas cylinder. First and second locking members are configured for selectively securing the first and second handle portions to one another about the periphery of the upper portion of the portable gas cylinder.

Preferably, each end of the shroud portion of the first handle portion includes a male coupling of adapted to receive one of the locking members. Each end of the shroud portion of the second handle portion includes a female coupling adapted to receive one of the locking members. The male coupling of the matable coupling includes a central cavity for receiving the locking member. The female coupling of the matable coupling includes a central channel for receiving the male coupling to connect the first and second handle portions together.

During assembly, insertion of the male coupling into the central channel of the female coupling generates a first audible clicking noise indicating the first and second handle portions are connected. Also during assembly, after the first audible clicking noise, insertion of the locking member into the central cavity of the male coupling generates a second audible clicking noise indicating that the first and second handle portions are locked together. Preferably, a distal end of each locking member includes protrusions for engaging corresponding indents formed within the central cavity of the male coupling. A distal end of the male coupling includes a bulb portion for engaging a corresponding recessed portion formed within the central channel of the female coupling. Each locking member includes a lower peripheral flange and an upper peripheral flange for guiding linear movement of the locking member in the central cavity of the male coupling.

The first handle portion includes apertures near proximal end portions of each of the first and second locking members for facilitating access to the proximal end portions of the first and second locking members from an exterior of the first handle portion. The handle assembly can also include a tool. The tool includes a loop at a proximal end and a chamfered portion at a distal end, with a bent portion therebetween. Each of the proximal end portions of the first and second locking members can include a reception bore accessible from the exterior of the first handle portion through the aperture for receiving the chamfered end of the tool to facilitate removal of the first and second locking members from the first and second handle portions.

It is also contemplated that in a disengaged position the bulb portion of the male coupling is not engaged with the recessed portion of the female coupling. In an engaged position the bulb portion of the male coupling is engaged with the recessed portion of the female coupling. A transition between the disengaged position and the engaged position generates a first audible clicking noise. Further, in an unlocked position, the locking member defined within the central cavity of the male coupling. In a locked position, lateral protrusions of the locking member are engaged with the indents of the male coupling. A transition between the unlocked position and the locked position generates a second audible clicking noise. The first and second audible clicking noises signal that the first and second handle portions are locked together.

Embodiments of the subject invention are also directed to a method of attaching a removable handle assembly to a portable gas cylinder. The method includes encircling a first section of an upper portion of a portable gas cylinder with a first handle portion, encircling a second section of the upper portion of the portable gas cylinder with a second handle portion, and securing the first and second handle portions to one another using locking members.

The method further includes coupling end portions of the first and second handle portions to one another using the locking members, and subsequently decoupling the end portions of the first and second handle portions from one another to enable the removal of the first and second handle portions from the periphery of the upper portion of the portable gas cylinder.

These and other features of the handle assembly of the embodiments of the subject invention and the manner in which it is manufactured and employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the embodiments of the subject invention appertains will readily understand how to make and use the removable handle assembly of the embodiments of the subject invention without undue experimentation, preferred embodiments thereof will be described in detail herein below with reference to certain figures, wherein.

DETAILED DESCRIPTION OF PREFERRED EMBODIMENTS

Figure 1:
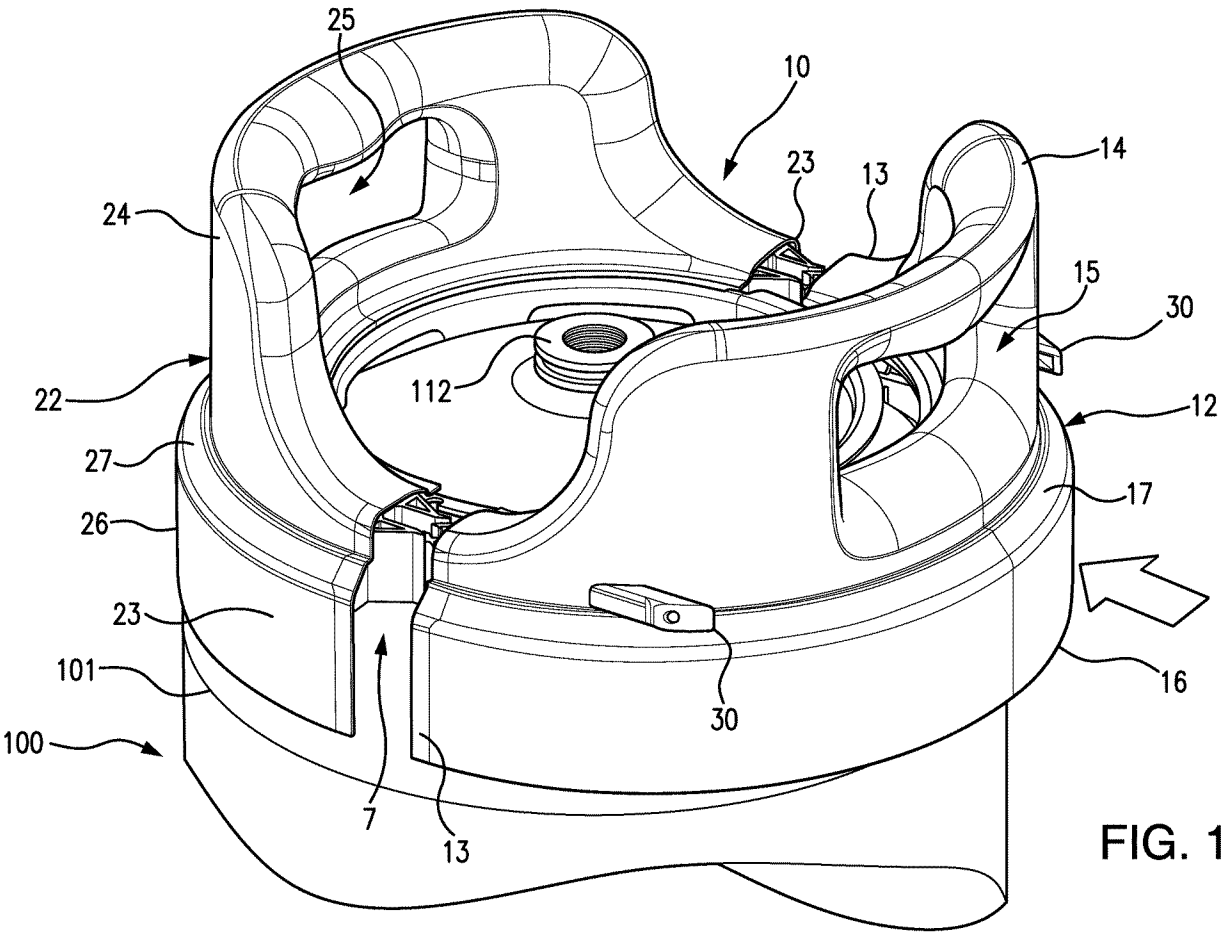
FIG. 1 is a perspective view the handle assembly constructed in accordance with embodiments of the subject invention as it is being assembled on the top portion of a portable gas cylinder.

Referring now to the drawings wherein like reference numerals identify similar structural features of the embodiments of the invention disclosed herein, there is illustrated in FIG. 1 a new and useful handle assembly for a portable gas cylinder that is constructed in accordance with a preferred embodiment of the subject invention and is designated generally by reference numeral 10. As best seen in FIG. 1, an upper portion 101 of a portable gas cylinder 100 includes a threaded fitting 112 for receiving a valve assembly (not shown). The handle assembly 10, in accordance with embodiments of the subject invention, is adapted and configured to protect the valve assembly, provide an ergonomic hand grip, and facilitate stacking of cylinders.

The handle assembly 10 includes a first handle portion 12 that includes an ergonomically configured upstanding gripping handle 14 and a semi-circular shroud portion 16 configured to encircle a first section of the upper portion 101 of the portable gas cylinder 100. The gripping handle 14 forms a handhold opening 15 for easy and comfortable handling. The shroud portion 16 has opposing ends 13 with male couplings 33, best seen in FIG. 2A. The gripping handle 14 is arcuate and has a smaller radius of curvature than the radius of curvature of the shroud portion 16. Gripping handle 14 is offset from the shroud portion 16 in a radially inward direction. A frustoconical shoulder portion 17 connects the shroud portion 16 to the gripping handle 14.

Still referring to FIG. 1, the handle assembly 10 further includes a second handle portion 22 that interlocks with the first handle portion 12. The second handle portion 22 also includes a complimentary ergonomic gripping handle 24 upstanding from a semi-circular shroud portion 26 that encircles a second section of the upper portion 101 of the portable gas cylinder 100. The gripping handle 24 defines a second handhold opening 25 opposing the other handhold opening 15 to facilitate manually handling the cylinder 100. The gripping handle 24 is arcuate and has a smaller radius of curvature than the radius of curvature of the semi-circular shroud portion 26, and is offset from the shroud portion 26 in a radially inward direction. A frustoconical shoulder portion 27 connects the shroud portion 26 to the gripping handle 24.

Figure 3:
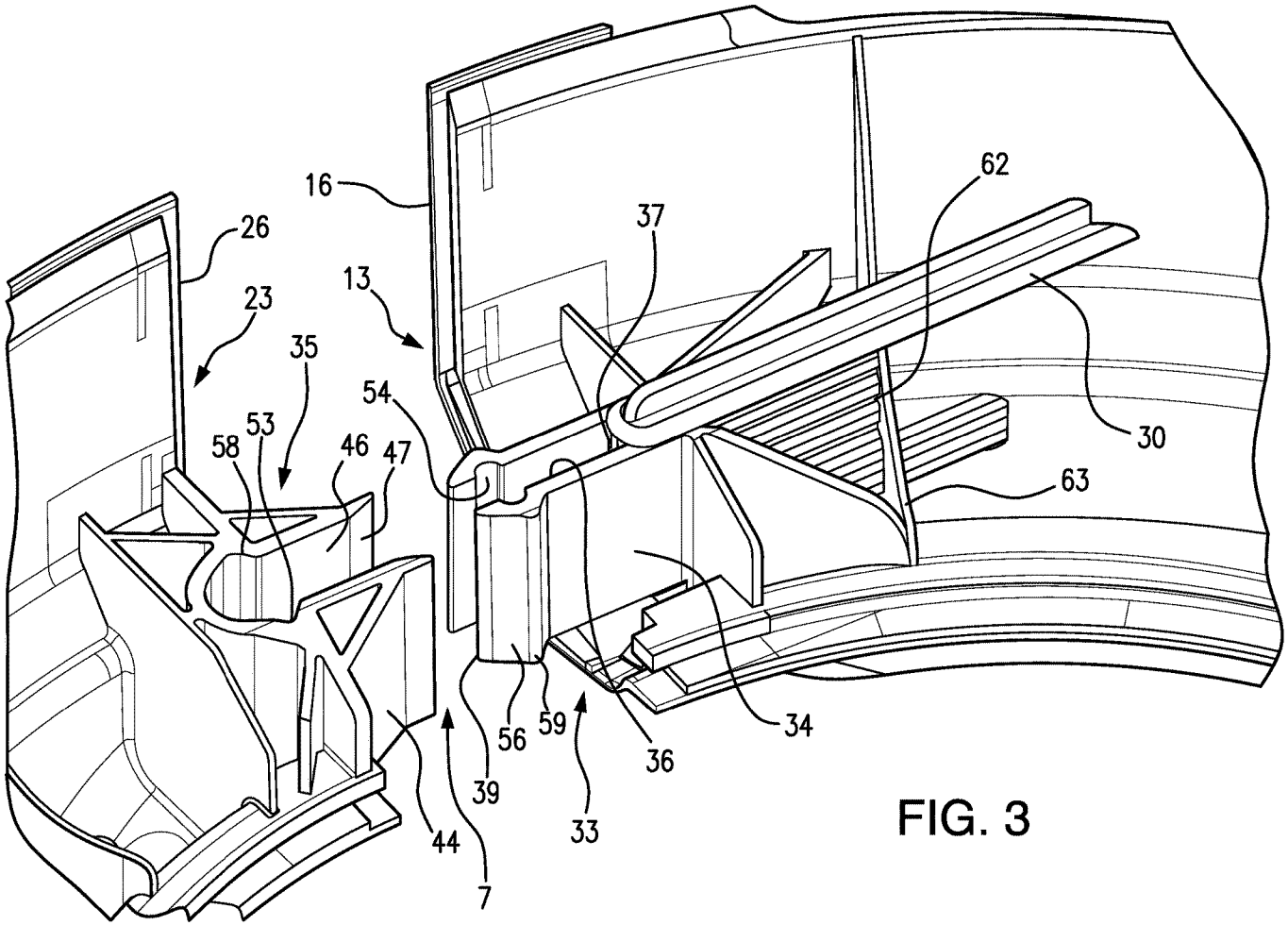
FIG. 3 is a perspective view of the mating end portion of both handles of the handle assembly, as viewed from the undersides thereof, illustrating the female and male portions of the matable coupling and the locking member operatively associated with the male portion of the coupling.

With continued reference to FIG. 1, the shroud portion 26 has opposing ends 23 with female couplings 35, best seen in FIG. 3, for engaging the male couplings 33 of the first handle portion 12. The handle assembly 10 further includes first and second locking members 30 for selectively securing the first and second handle portions 12 and 22, respectively, to one another about the periphery of the upper portion 101 of the portable gas cylinder 100.

Figure 2A:
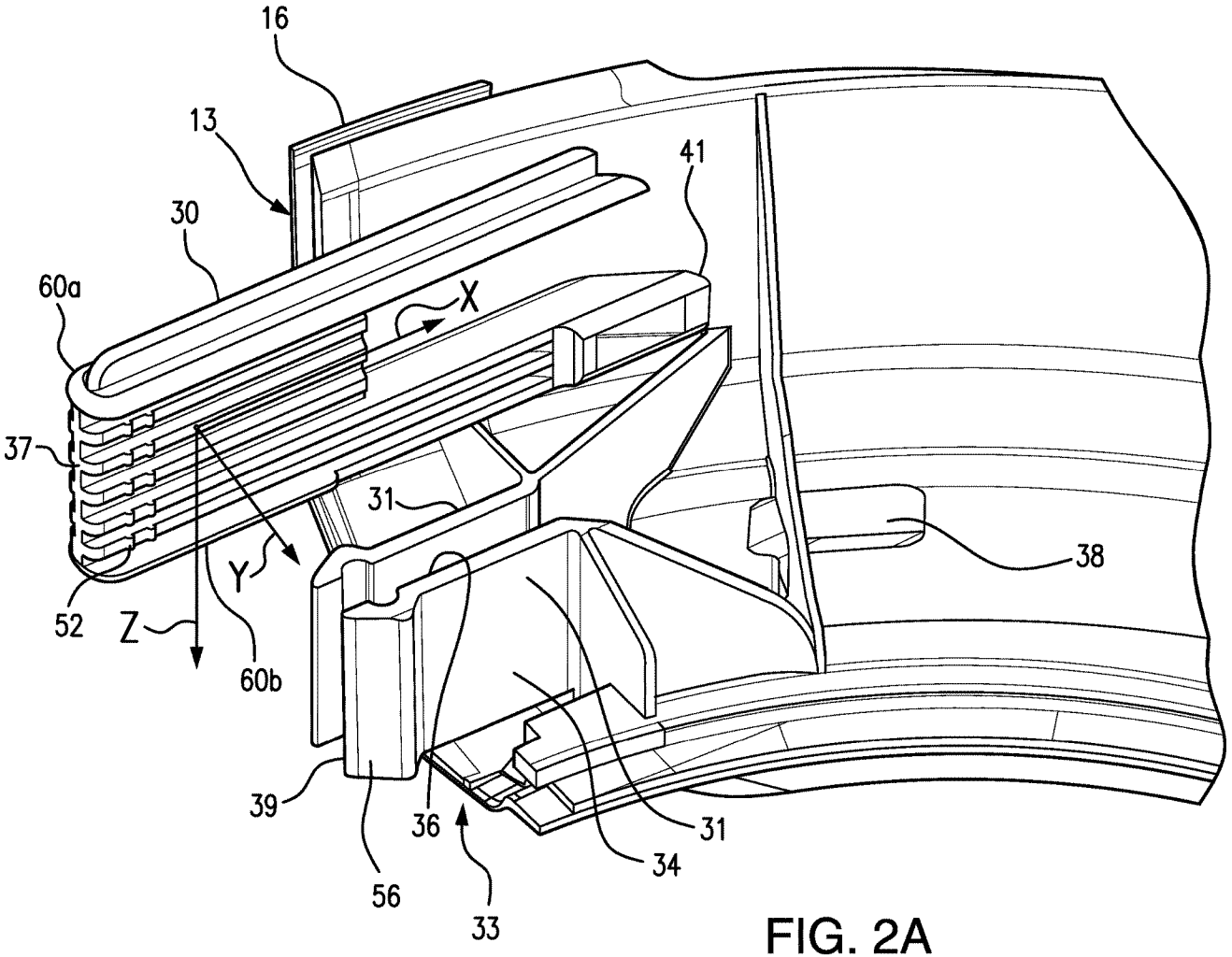
FIG. 2A is a perspective view of an end portion of one of the handles of the handle assembly, as viewed from the underside thereof, illustrating the male portion of the matable coupling and the locking member separated therefrom.

Referring now to FIG. 2A, one end 13 of the first handle portion 12 is shown from an inner perspective, with the locking member 30 completely disengaged from the shroud portion 16. Each end 13 includes the male coupling 33 of a matable coupling 7 adapted to receive one of the locking members 30. The male coupling 33 of the matable coupling 7 includes a male portion 34. The male portion 34 includes opposing flexible plates 31 that define a central cavity 36 therebetween for receiving the locking member 30. The flexible plates 31 terminate in a bulb portion 56 near a distal end 39 of the male portion 34. The bulb portion 56 includes arcuate portions of opposing flexible plates 31 that protrude away from the central cavity 36. The first handle portion 12 includes apertures 38 near the proximal end portions 41 of each of the first and second locking members 30 for facilitating access to the proximal end portions 41 of the first and second locking members 30 from an exterior of the first handle portion 12.

Figure 2B:
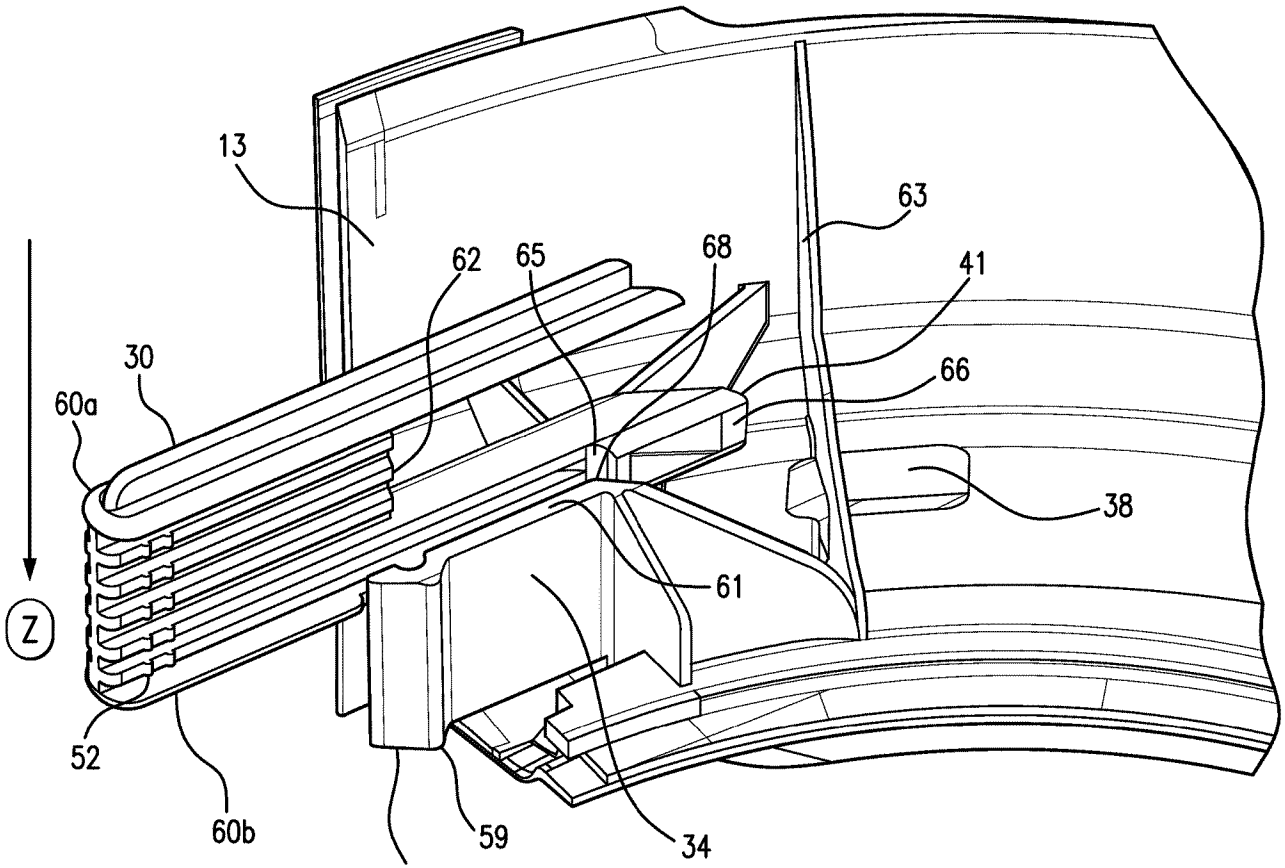
FIGS. 2B through 2D are perspective views of an end portion of one of the handles of the handle assembly, as viewed from the underside thereof, illustrating the insertion of the locking member into the male portion of the matable coupling.
Figure 2C:
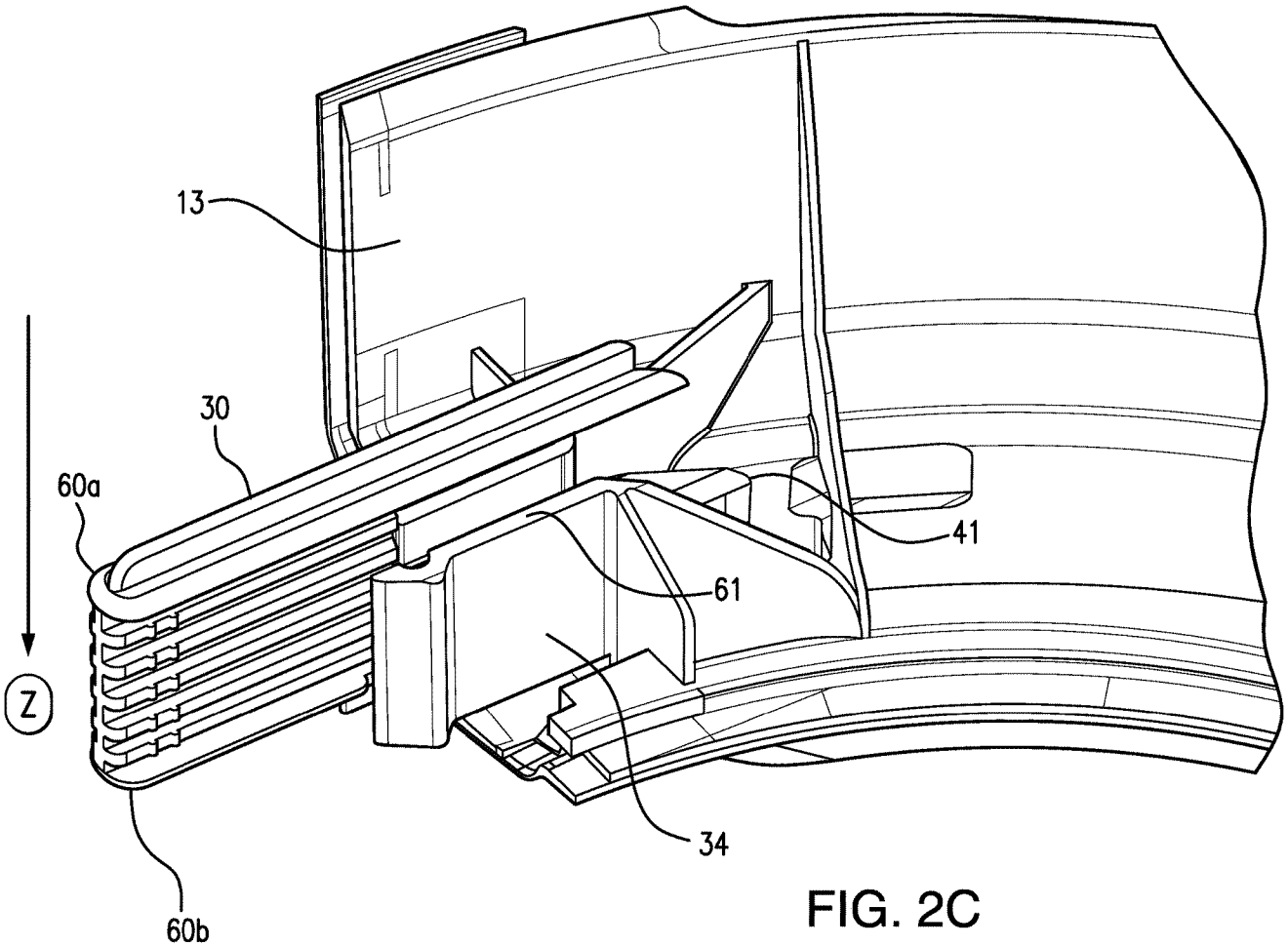
Figure 2D:
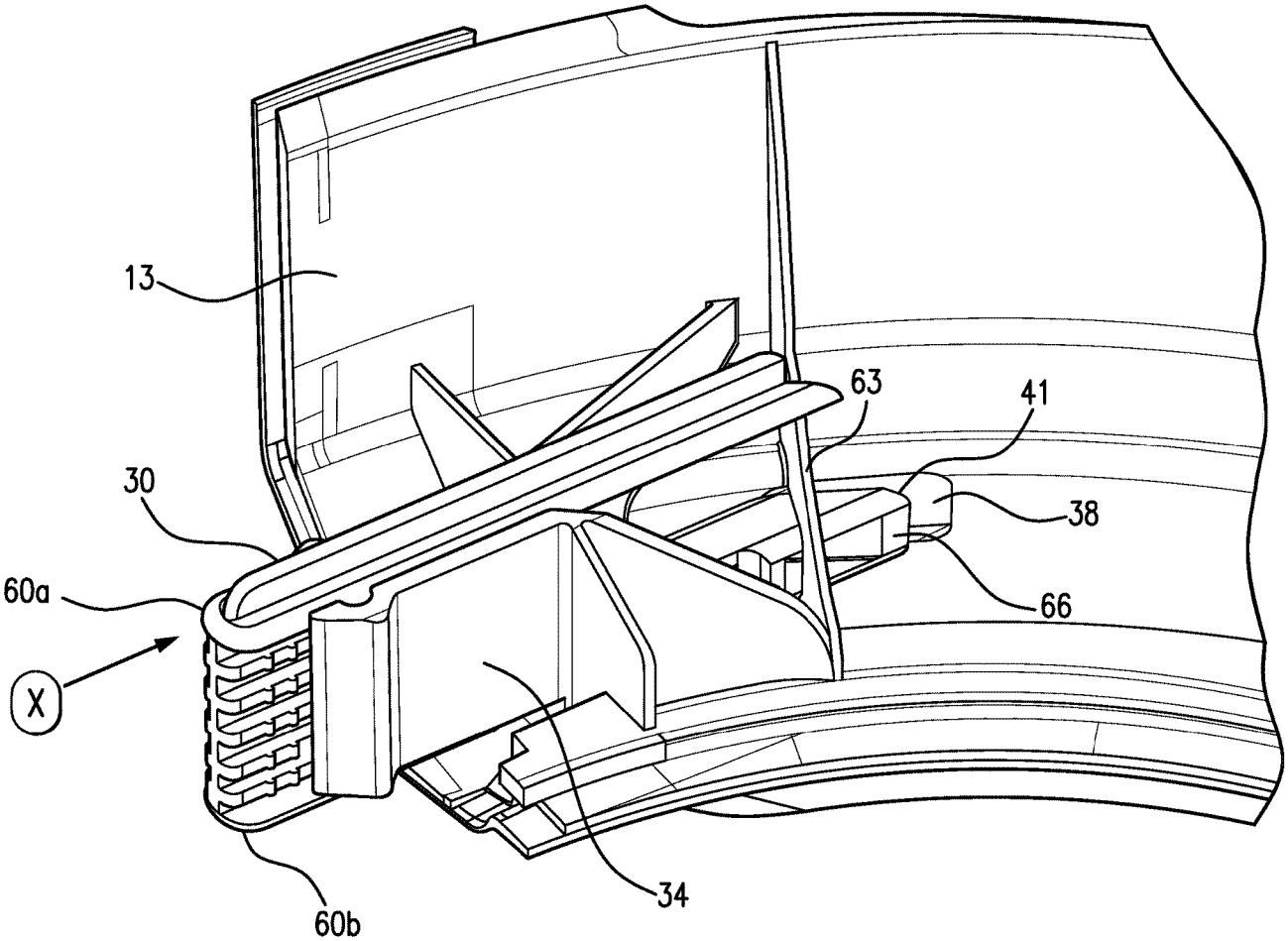

Now with reference to FIGS. 2B-2D, the locking member 30, shown from an inner perspective, is being inserted into the male portion 34 of the matable coupling 7. The locking member 30 includes lower and upper peripheral flanges 60*a* and 60*b*, respectively. The lower peripheral flange 60*a* is formed about a lower periphery of the locking member 30 and the upper peripheral flange 60*b* is formed about an upper periphery of the locking member 30. Lower and upper peripheral flanges 60*a* and 60*b*, respectively, are for controlling the engagement of the locking member 30 with the central cavity 36 in the male portion 34 of the coupling 7. As best seen in FIG. 2D, the lower peripheral flange 60*a* engages with a lower surface 61 of the male portion 34 and the upper peripheral flange 60*b* engages with a surface opposed to lower surface 61, essentially creating a track to limit the travel of the locking member 30 along a single axis, indicated schematically by the arrow in FIGS. 2B-2D.

As shown in FIG. 2B, the locking member 30 includes a raised section 66 near its proximal end 30. Transitioning between the raised section 66 and the rest of locking member 30 is a concave fillet portion 65. The concave fillet portion 65 abuts a proximal edge 68 of the male portion 34 of the matable coupling 7, acting to prevent the locking member 30 from moving too far in the distal direction, e.g. towards the female portion 44 of the matable coupling 7.

With continued reference to FIGS. 2B-2D, the locking member 30 includes an inner surface 62. The inner surface 62 is between the lower and upper peripheral flanges 60*a* and 60*b*, respectively. The inner surface 62 controls the engagement of the locking member 30 with the central cavity 36 in the male portion 34 of the coupling 7, in the X-direction by preventing locking member 30 from moving too far in the proximal direction, e.g. away from the female portion 44 of the matable coupling 7.

As shown in FIG. 2B, each end 13 of the first handle portion 12 includes a backstop 63. As best seen in FIG. 3, the backstop 63 engages with the inner surface 62 when the locking member 30 is in an unlocked position to limit the locking member 30 from traveling too far in the proximal direction toward the outer diameter of the first handle portion 12.

As best seen in FIG. 3, each end 23 of the second handle portion 22 includes the female coupling 35 of the matable coupling 7 adapted to receive one of the locking members 30, which is shown engaged with the central cavity 36 of the male portion 34, but still remains in an unlocked ready position so that the matable coupling 7 may be assembled. The female coupling 35 includes a female portion 44 that includes a central channel 46 for receiving the male portion 34 of the male coupling 33. The female portion 44 includes a tapered opening defined by a diverging surface 47. The diverging surface 47 diverges in a direction towards the male portion 34 to facilitate entry of the distal end 39 of the male portion 34.

Referring now to FIGS. 2A and 3, male and female couplings 33 and 35, respectively, of the matable coupling 7 are in an unlocked position. A distal end 37 of locking member 30 includes lateral protrusions 52 for engaging corresponding indents 54 formed within the central cavity 36 of the male portion 34 of the coupling, as best seen in FIG. 8B. The bulb portion 56 of the male portion 34 is configured to engage a corresponding recessed portion 58 formed within the central channel 46 of the female portion 44 of the coupling 7. The recessed portion 58 includes opposing keyholes 53 that are complementary to the extended portions 59 of the bulb portion 56.

Figure 4:
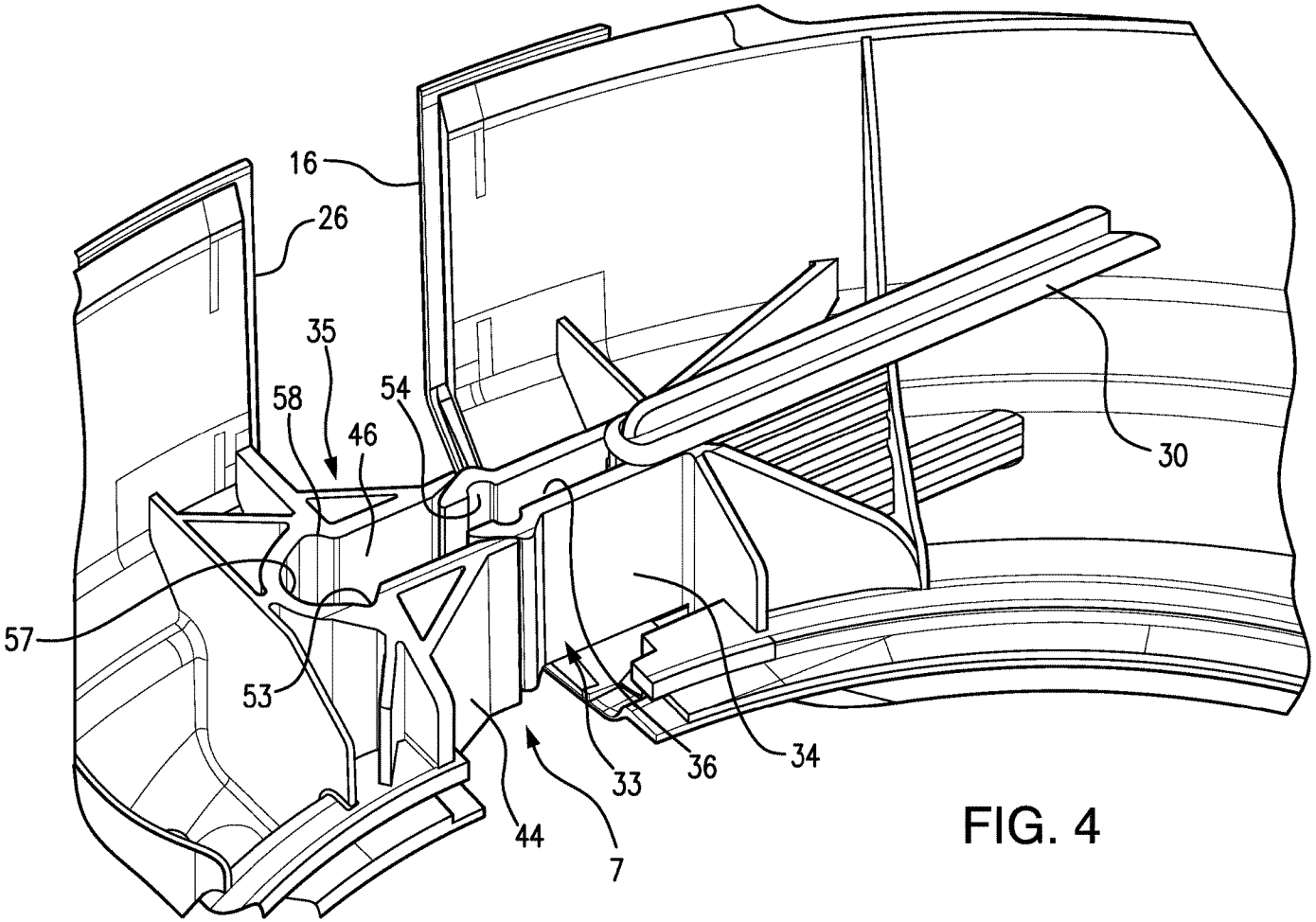
FIGS. 4 through 6 illustrate the active engagement of the male and female portions of the matable coupling, wherein the male portion of the coupling is received in the central channel of the female portion of the coupling and the locking member is received in the central cavity of the male portion of the coupling.
Figure 5:
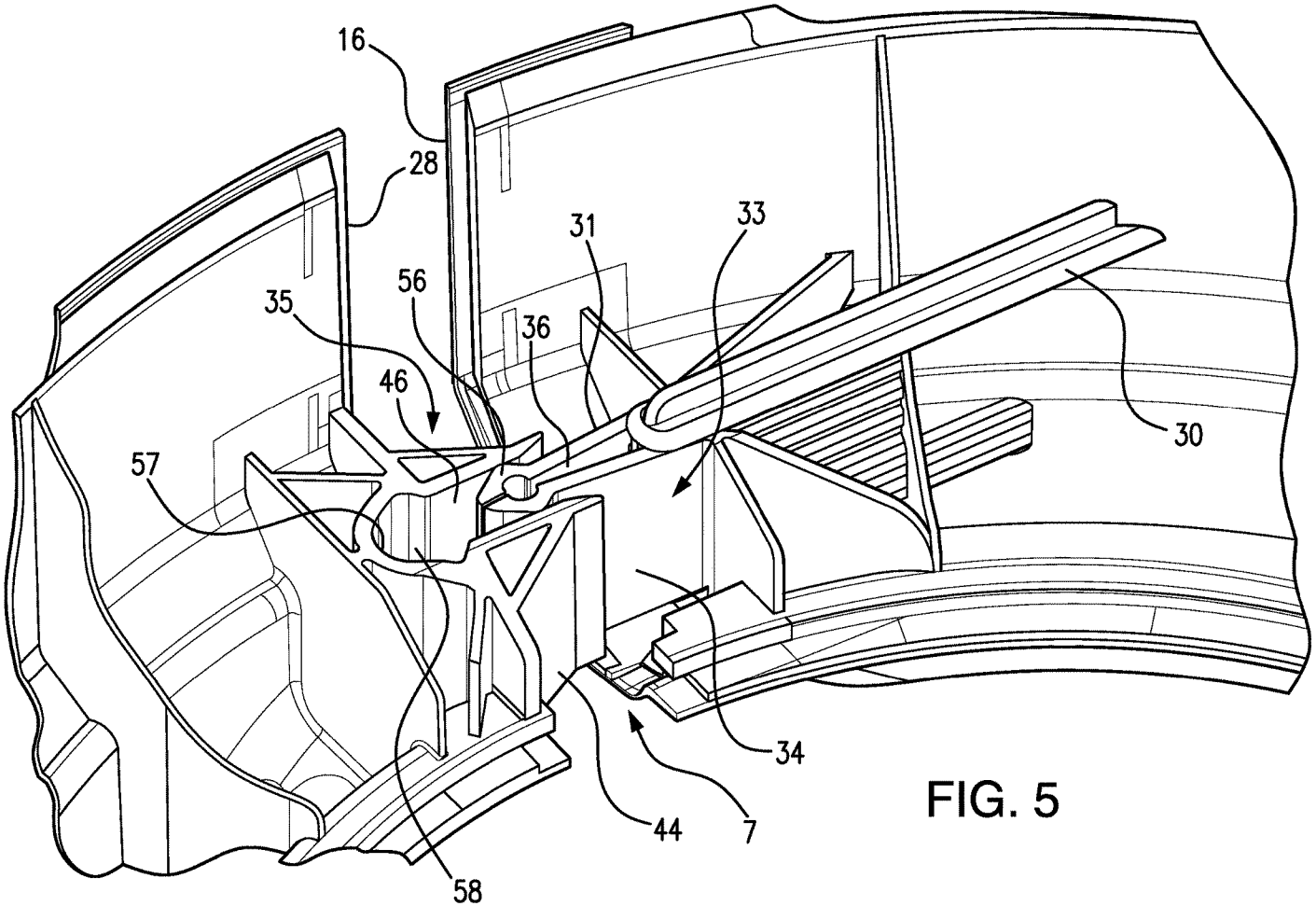

As shown in FIGS. 4 and 5, the locking member 30 is necessarily still in the disengaged position, while the male and female couplings 33 and 35, respectively, of the matable coupling 7 are shown in a first stage of engagement where the male portion 34 of the matable coupling 7 is being inserted into the female portion 44. As best shown in FIG. 5, the bulb portion 56 of the male portion 34 is compressed together by the walls of the central channel 46 of the female portion 44 as the male and female couplings 33 and 35, respectively, of the matable coupling 7 move together. The compression of the bulb portion 56 causes the flexible plates 31 to bend inward toward the central cavity 36.

Figure 6:
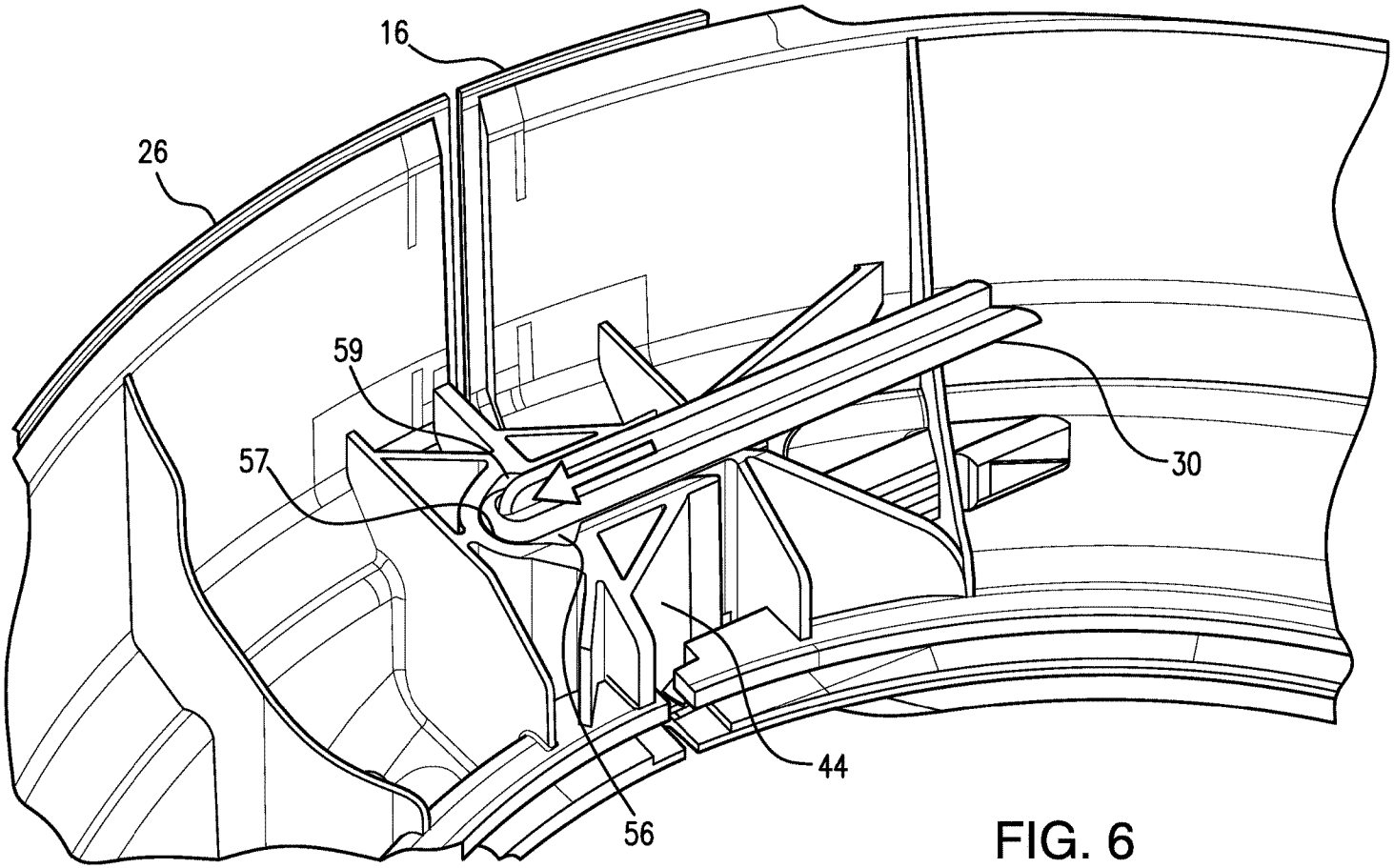

Now with reference to FIG. 6, once the male and female couplings 33 and 35, respectively, of the matable coupling 7 are engaged so that the bulb portion 56 of the male portion 34 reaches the corresponding recessed portion 58 formed within the central channel 46 of the female portion 44, the extended portions 59 of the bulb portion 56 pop into keyholes 53 generating an audible click to inform the user of positive, effective engagement.

Figure 7:
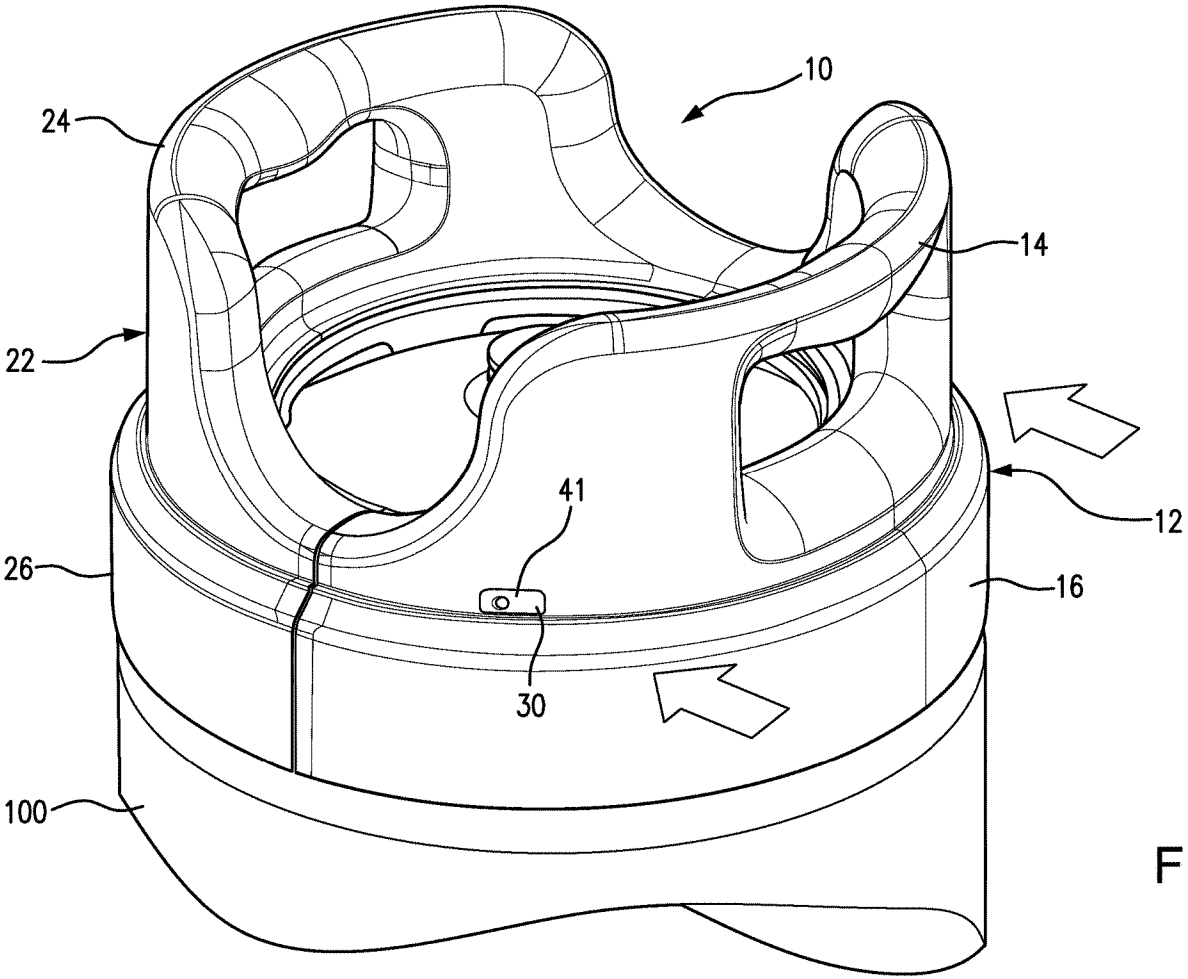
FIG. 7 is a perspective view of the handle assembly constructed in accordance with embodiments of the subject invention in a fully assembled condition on the top portion of a portable gas cylinder, with the locking members in a blocking position.

With reference now to FIGS. 5-7, once the male and female couplings 33 and 35, respectively, of the matable coupling 7 are mated together, the locking member 30 slides distally through the central cavity 36 of the male portion 44 until the distal end 37 of the locking member 30 abuts a surface 57 of the recessed portion 58. The lateral protrusions 52 engage with indents 54, as best shown in FIG. 8B, making a second clicking noise, locking the two matable coupling structures 34, 44 together and thereby securing the first and second handle portions 12, 22, respectively, to one another, as shown in FIG. 7. When the user hears the second "click" the locked position is confirmed. As a result of insertion of the locking member 30 into the central cavity 36 of the male portion 34 of the coupling 7, the male portion 34 of the coupling 7 is prevented from compressing within the central channel 46 of the female portion 44 of the coupling 7.

As shown in FIG. 7, proximal end portions 41 of each of the locking members 30 are accessible from outside of the first handle portion 12 through apertures 38, described above. A force applied to the proximal end portions 41 initiates the distal sliding movement of each locking member 30, described above. This is indicated schematically by the block arrows shown in FIG. 7.

Figure 8A:
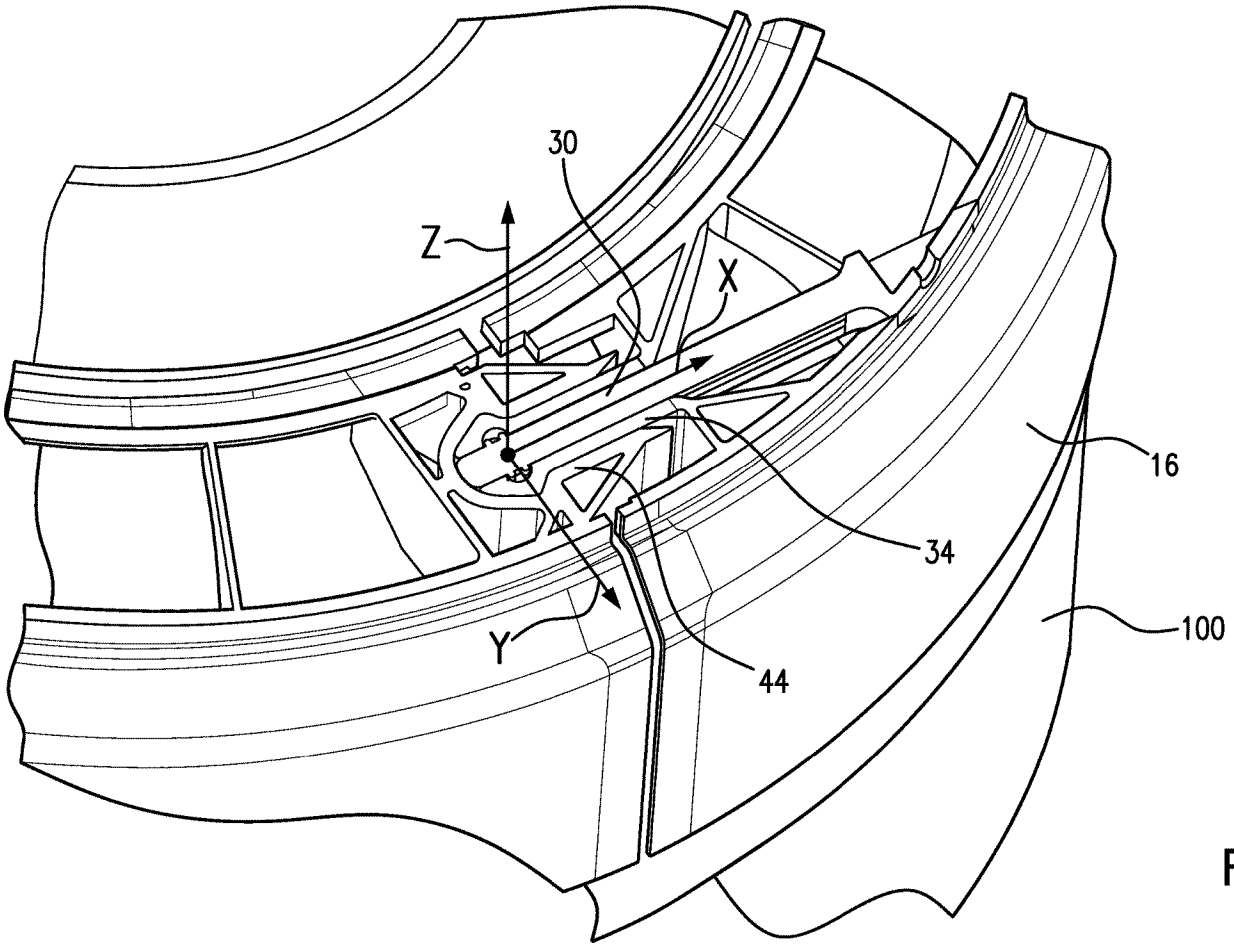
FIG. 8A is a perspective view of a cross-section of the fully engaged coupling, as viewed from the underside thereof, illustrating the various directional force and reaction vectors involved in the locked coupling system.
Figure 8B:
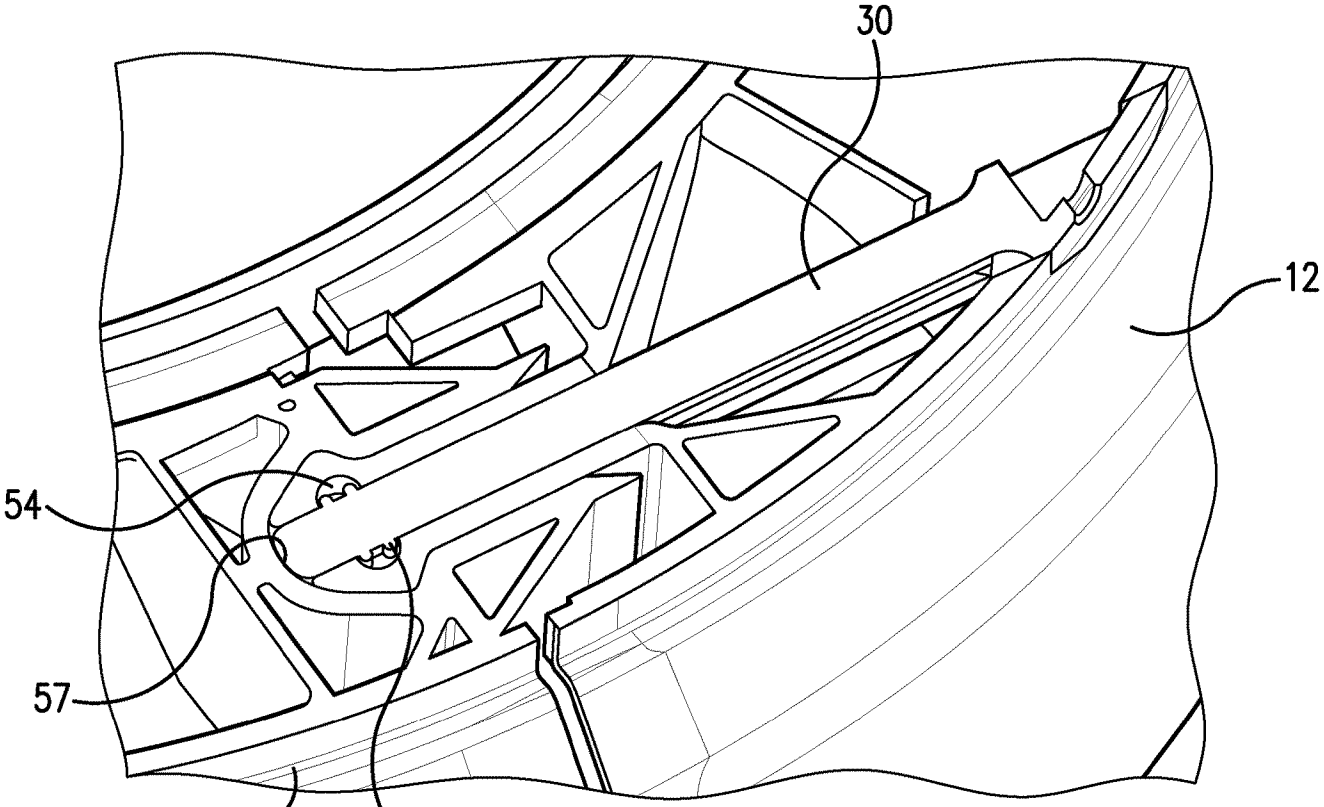
FIG. 8B is a perspective view of a cross-section of the fully engaged coupling, as viewed from the underside thereof, illustrating the lateral protrusions locked within the indents.

FIG. 8A illustrates the locking member 30, and the male and female couplings 33 and 35, respectively, of the matable coupling 7 in a fully engaged, e.g. locked, position. The directional forces and reaction vectors that are established within the two portions 12, 22 of handle assembly 10 when a locking member 30 is engaged with the two coupling structures 34, 44, are shown schematically by the vector arrows. FIG. 8B illustrates the locking member 30 in a locked position with the lateral protrusions 52 engaged with the indents 54.

Figure 9:
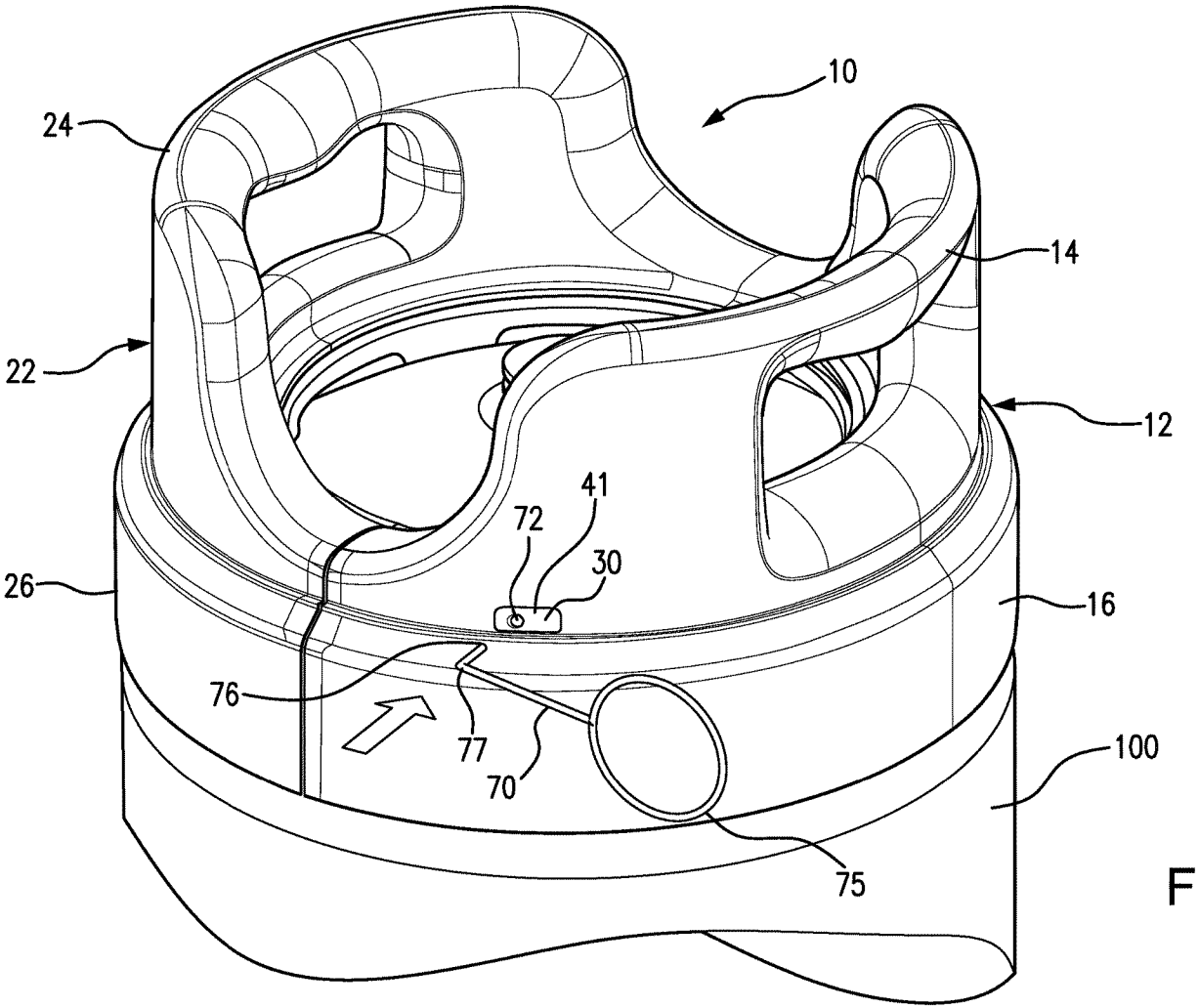
FIG. 9 is a perspective view of a portable gas cylinder with the handle assembly constructed in accordance with embodiments of the subject invention, and illustrating the tool used to release the locking members and thereby enable the removal of the handle assembly from the top portion of the gas cylinder.
Figure 10:
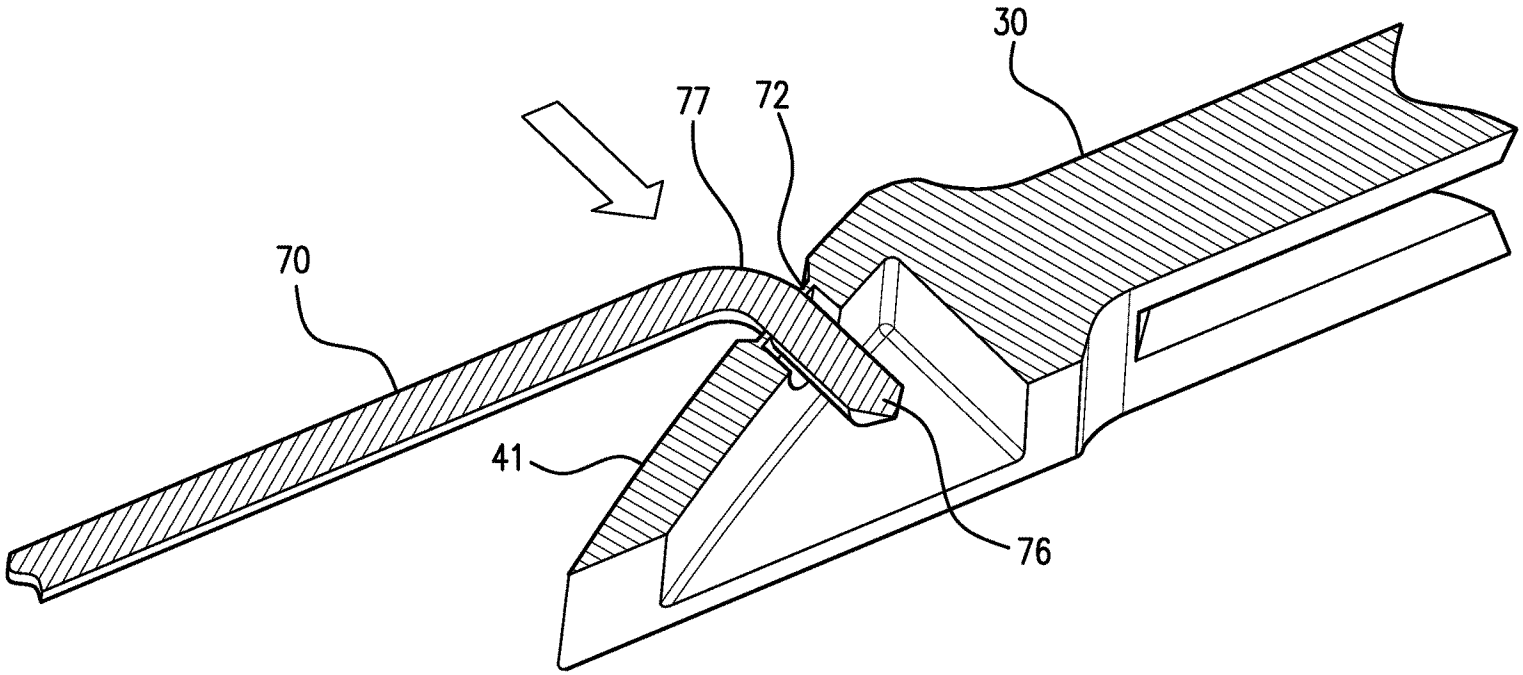
FIG. 10 illustrates the engagement of the tool and a locking member.

Referring to FIGS. 9 and 10, a tool 70 is provided for removing the first and second locking members 30 from the first and second handle portions 12 and 22, respectively, to remove the handle assembly 10 from the periphery of the upper portion of the portable gas cylinder 100. The tool 70 includes a loop 75 at the proximal end and a chamfered portion 76 at the distal end, with a bent portion 77 therebetween. As best seen in FIG. 10, the proximal end portion 41 of each locking member 30 includes a reception bore 72 for receiving the chamfered portion 76 of the tool 70 to facilitate the removal of the locking members 30 from the first and second handle portions 12 and 22, respectively.

With continued reference to FIG. 10, the bent portion 77 helps to anchor the tool 70 within the reception bore 72 so that a user can pull the loop 75 in the proximal direction without the tool disengaging from the reception bore 72. To release the locking member 30 with the tool 70 the user pulls the loop 75 in the proximal direction, thereby pulling the lateral protrusions 52 of the locking member 30 out from the indents 54 of the male portion 34. This releases the locking member 30 but does not remove it from the male portion 34, as the backstop 63 in conjunction with the inner surface 62 of the locking member, shown in FIGS. 2B-2D, prevents excess movement in the proximal direction.

Figure 11:
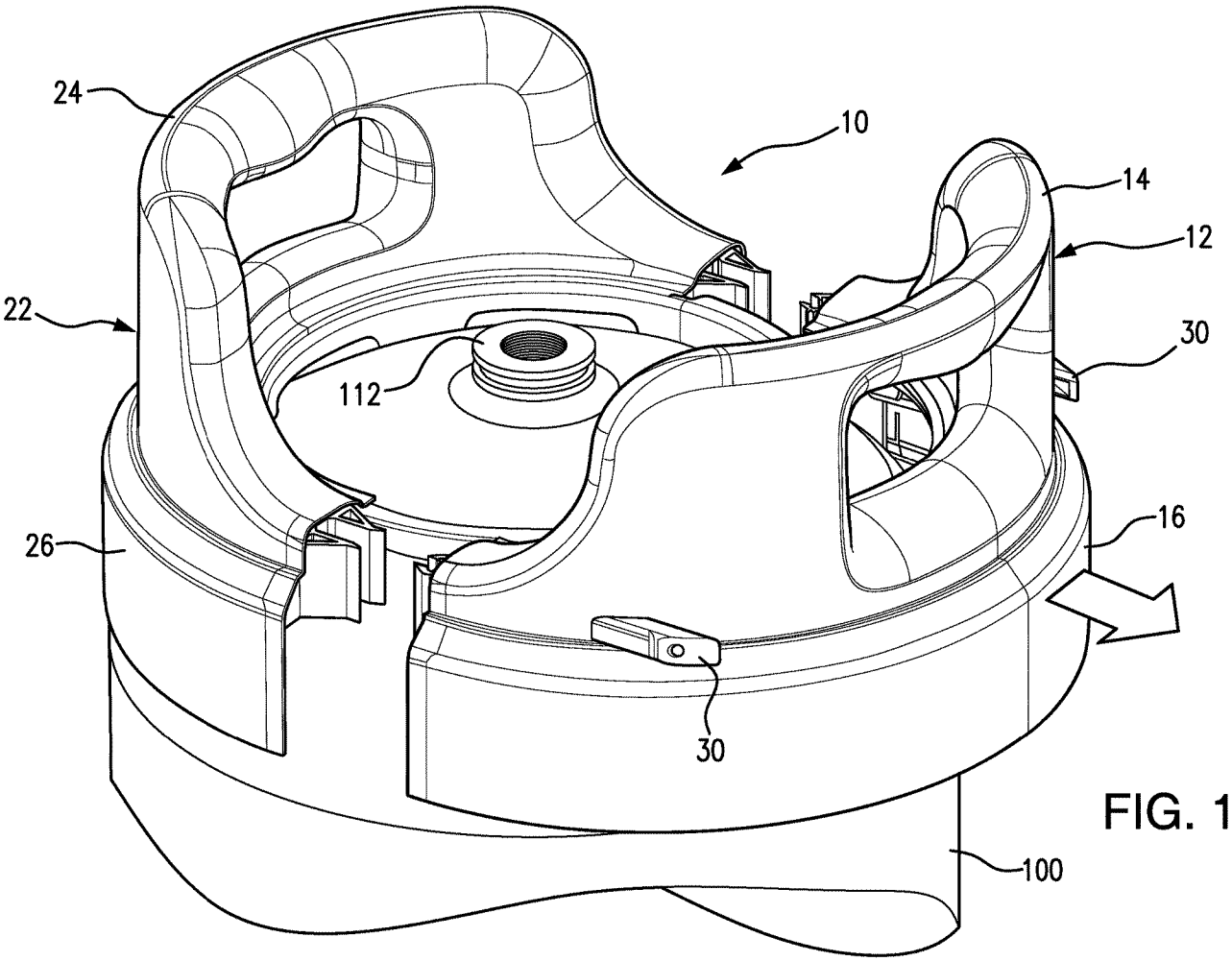
FIG. 11 illustrates the removal of the handle assembly from the top portion of the portable gas cylinder after the locking members have been released.

Once the two locking members 30 have been released with the tool 70, the first and second handle portions 12 and 22, respectively, of handle assembly 10 can be removed from the portable gas cylinder 100, as shown in FIG. 11. At such a time, the gas cylinder 100 can be inspected, refurbished or discarded, and the handle assembly 100 can be reused with another gas cylinder.

Figure 12:
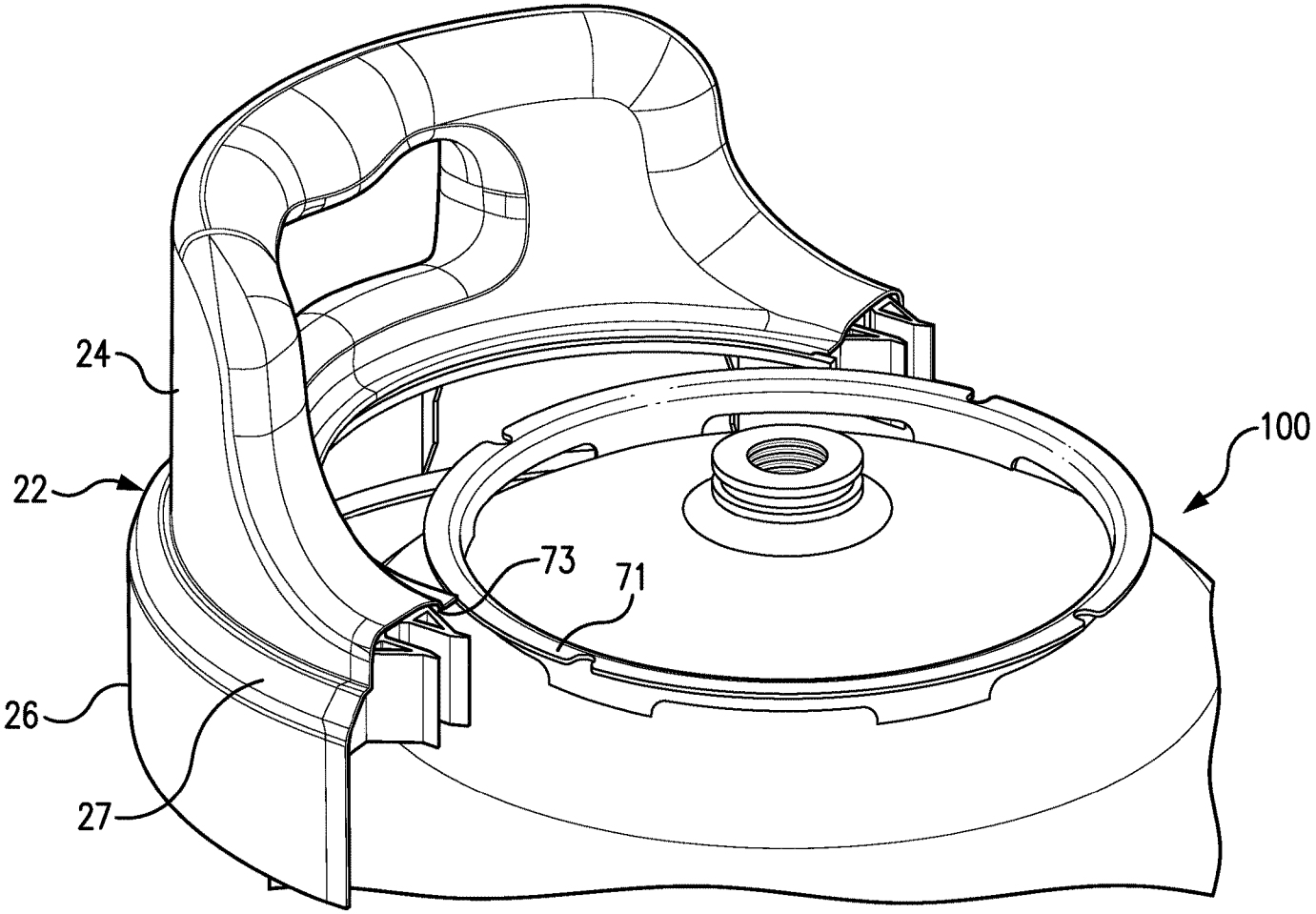
FIG. 12 is a perspective view of one of the handle portions as it is being assembled on the top portion of a portable gas cylinder, showing the engagement between a collar of the gas cylinder and an annular groove of the handle portion.

As shown in FIG. 12, gas cylinder 100 includes a collar 71 that nests within an annular groove 73 of the second handle portion 22. While not shown, those skilled in the art will readily appreciate that the handle portion 12 includes a similar annular groove for engaging with the collar 71.

While the subject invention has been shown and described with reference to preferred embodiments, those skilled in the art will readily appreciate that various changes and/or modifications may be made thereto without departing from the spirit and scope of the subject invention as defined by the appended claims.

What is claimed is:

1. A handle assembly for a portable gas cylinder comprising:

a) a first handle portion including an ergonomically configured upstanding gripping handle and a semi-circular shroud portion configured to couple to a first section of an upper portion of a portable gas cylinder;

b) a second handle portion including an ergonomically configured upstanding gripping handle and a semi-circular shroud portion configured to couple to a second section of the upper portion of the portable gas cylinder; and c) first and second locking members for selectively locking the first and second handle portions to one another about a periphery of the upper portion of the portable gas cylinder, wherein the first handle portion includes a male coupling adapted to receive one of the first and second locking members, wherein the male coupling includes a central cavity for receiving one of the first and second locking members, wherein a distal end of each locking member includes protrusions for engaging corresponding indents formed within the central cavity of the male coupling.

2. A handle assembly as recited in claim 1, wherein the second handle portion includes a female coupling adapted to receive the male coupling.

3. A handle assembly as recited in claim 2, wherein the female coupling includes a central channel for receiving the male coupling to connect the first and second handle portions together.

4. A handle assembly as recited in claim 3, wherein during assembly, insertion of the male coupling into the central channel of the female coupling generates a first audible clicking noise indicating the first and second handle portions are connected, and insertion of the locking member into the central cavity of the male coupling generates a second audible clicking noise indicating that the first and second handle portions are locked together.

5. A handle assembly as recited in claim 3, wherein a distal end of the male coupling includes a bulb portion for engaging a corresponding recessed portion formed within the central channel of the female coupling.

6. A handle assembly as recited in claim 3, wherein each locking member includes a lower peripheral flange and an upper peripheral flange for guiding linear movement of the locking member in the central cavity of the male coupling.

7. A handle assembly as recited in claim 1, wherein the first handle portion includes apertures near proximal end portions of each of the first and second locking members for facilitating access to the proximal end portions of the first and second locking members from an exterior of the first handle portion.

8. A handle assembly as recited in claim 7, further comprising a tool including a loop at a proximal end and a chamfered portion at a distal end, with a bent portion therebetween, wherein each of the proximal end portions of the first and second locking members include a reception bore accessible from the exterior of the first handle portion through the aperture for receiving the chamfered end of the tool to facilitate removal of the first and second locking members from the first and second handle portions.

9. A method of attaching a handle assembly to a portable gas cylinder, the method comprising:

a) encircling a first section of an upper portion of a portable gas cylinder with a first handle portion;

b) encircling a second section of the upper portion of the portable gas cylinder with a second handle portion; and c) securing the first and second handle portion to one another using locking members, wherein the first handle portion includes a male coupling adapted to receive one of the locking members, wherein the male coupling includes a central cavity for receiving one of the locking members, wherein a distal end of each locking member includes protrusions for engaging corresponding indents formed within the central cavity of the male coupling.

10. A method according to claim 9, further comprising coupling end portions of the first and second handle portions to one another using the locking members.

11. A method according to claim 9, further comprising decoupling end portions of the first and second handle portions from one another to enable removal of the first and second handle portions from a periphery of the upper portion of the portable gas cylinder.

12. A handle assembly for a portable gas cylinder comprising:

a) a first handle portion including a gripping handle and a semi-circular shroud portion configured to encircle a first section of a portable gas cylinder, wherein an end of the shroud portion of the first handle portion includes a male coupling with a central cavity having indents, and wherein a distal end of the male coupling includes a bulb portion; and b) a second handle portion including a gripping handle and a semi-circular shroud portion configured to encircle a second section of the portable gas cylinder, wherein an end of the shroud portion of the second handle portion includes a female coupling having a central channel for receiving the male coupling, wherein the central channel of the female coupling includes a recessed portion corresponding to the bulb portion of the male coupling, wherein in a disengaged position the bulb portion of the male coupling is not engaged with the recessed portion of the female coupling, wherein in an engaged position the bulb portion of the male coupling is engaged with the recessed portion of the female coupling, and wherein a transition between the disengaged position and the engaged position generates a first audible clicking noise; and c) a locking member for securing the first and second handle portions to one another, wherein a distal end of the locking member includes lateral protrusions, wherein in an unlocked position the locking member is defined within the central cavity of the male coupling, wherein in a locked position the lateral protrusions of the locking member are engaged with the indents of the male coupling, and wherein a transition between the unlocked position and the locked position generates a second audible clicking noise, wherein the first and second audible clicking noises signal that the first and second handle portions are locked together.

* * * * *